United States Patent [19]

Evans et al.

[11] 4,130,069

[45] Dec. 19, 1978

[54] VERTICALLY-ADJUSTABLE TWO-POST DRAFTING TABLE

[75] Inventors: David F. Evans; Leonard J. Yindra, both of Manitowoc, Wis.

[73] Assignee: American Hospital Supply Corporation, Evanston, Ill.

[21] Appl. No.: 883,057

[22] Filed: Mar. 3, 1978

Related U.S. Application Data

[63] Continuation of Ser. No. 744,520, Nov. 24, 1976.

[51] Int. Cl.[2] ..... A47B 9/02

[52] U.S. Cl. ..... 108/136; 108/144

[58] Field of Search ..... 108/6, 10, 136, 144, 108/2.1, 87, 147; 5/63; 312/194

[56] References Cited

U.S. PATENT DOCUMENTS

| | | | |
|---|---|---|---|
| 918,240 | 4/1909 | Wheeler | 108/147 |
| 2,404,949 | 7/1946 | De Lisle | 108/146 |
| 2,560,928 | 7/1951 | Bockius | 108/136 |
| 3,311,337 | 3/1967 | Hagen | 248/188.5 |
| 3,334,951 | 8/1967 | Douglass | 108/147 |
| 3,370,556 | 2/1968 | Kooi | 108/136 |
| 3,820,176 | 6/1974 | Feiertag | 5/63 |
| 3,820,478 | 6/1974 | Bergenthal | 108/136 |
| 3,896,744 | 7/1975 | Goebl | 108/146 |

FOREIGN PATENT DOCUMENTS

| | | | |
|---|---|---|---|
| 2345248 | 3/1975 | Fed. Rep. of Germany | 108/144 |

*Primary Examiner*—Francis K. Zugel

*Attorney, Agent, or Firm*—Tilton, Fallon, Lungmus & Chestnut

[57] ABSTRACT

A vertically-adjustable drafting table having a base with a pair of telescoping support columns defining an open area between the columns suitable for accommodating any of a variety of modular storage unit combinations. Vertical adjustment of the table top occurs through synchronized and counterbalanced extension and retraction of the telescoping support columns, such synchronizing and counterbalancing being achieved by mechanism housed completely within the base assembly.

3 Claims, 6 Drawing Figures

FIG. 1
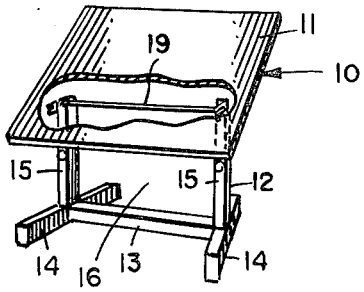
FIG. 2
FIG. 3
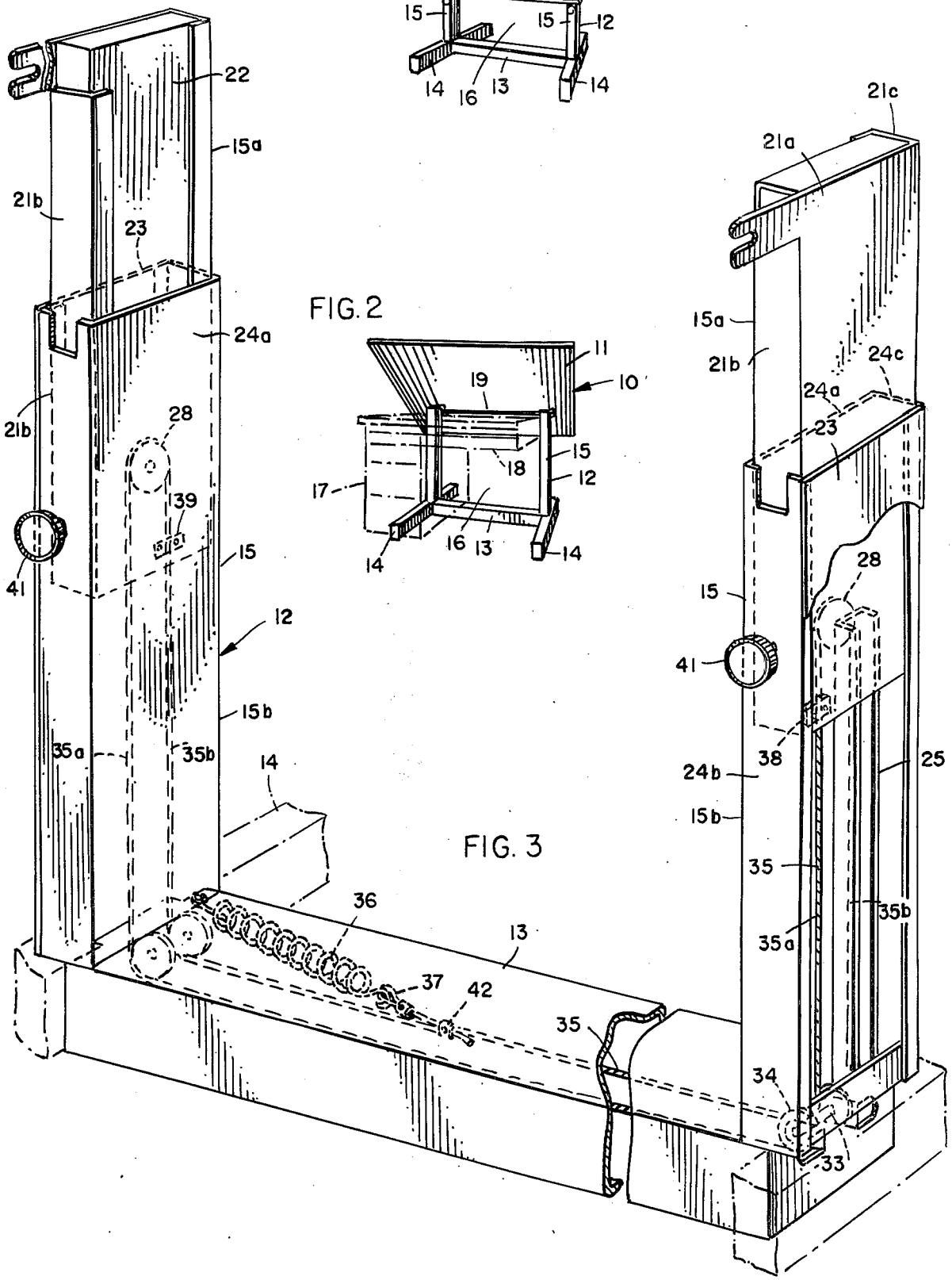

FIG. 5
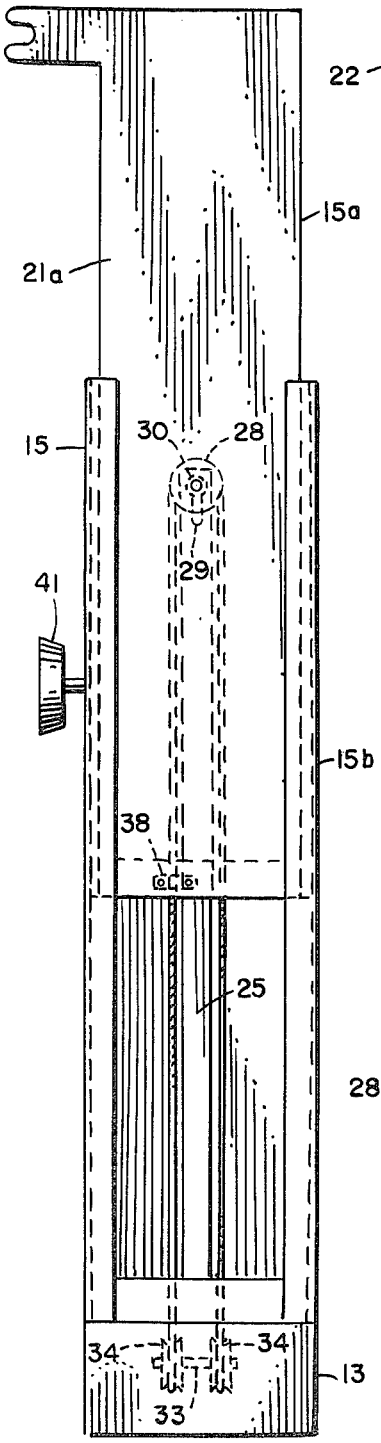
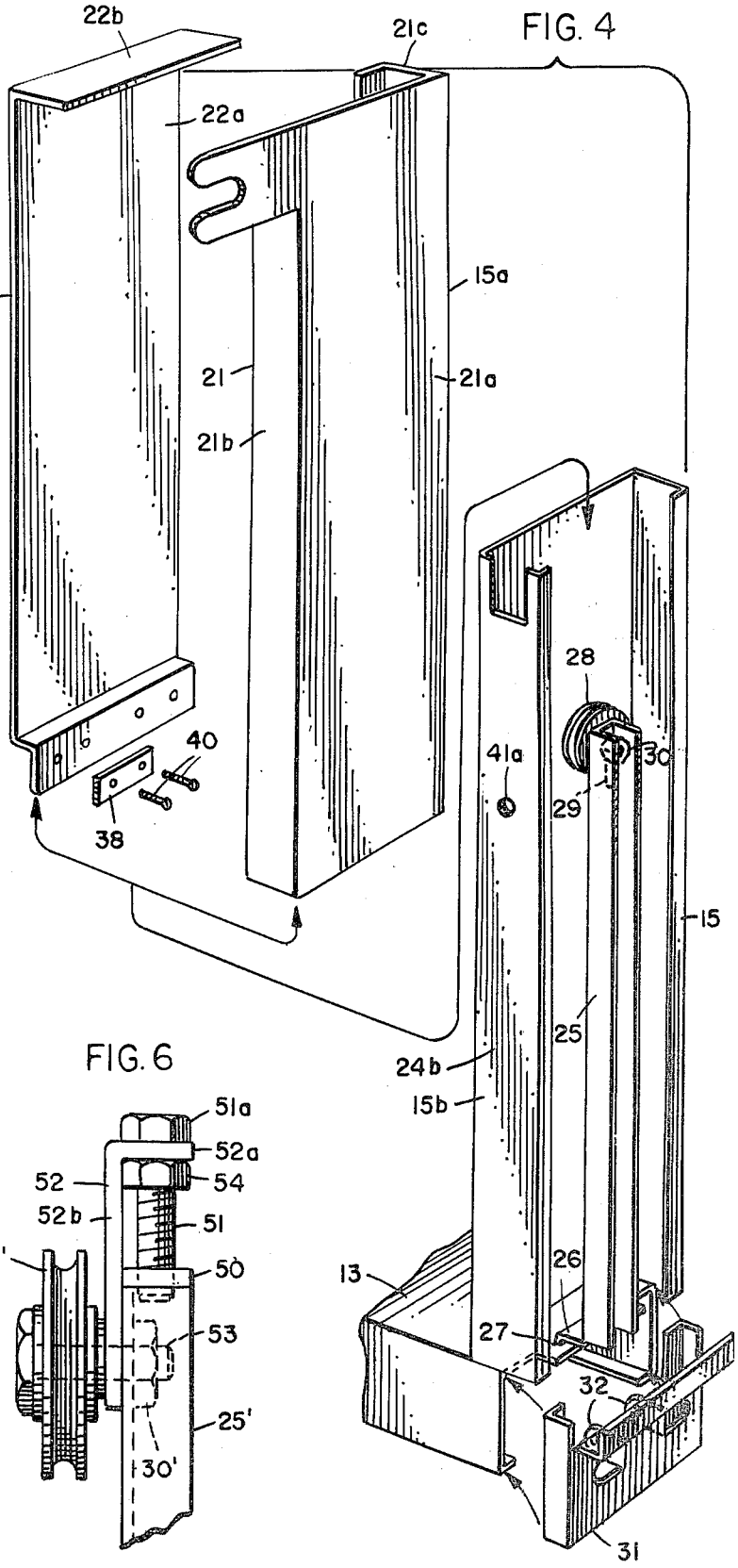
FIG. 6
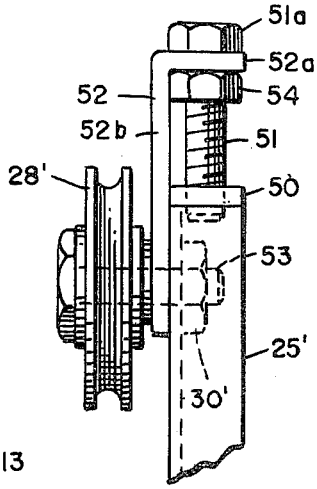

VERTICALLY-ADJUSTABLE TWO-POST DRAFTING TABLE

RELATED APPLICATION

This application is a continuation of co-pending application Ser. No. 744,520, filed Nov. 24, 1976.

BACKGROUND AND SUMMARY

Drafting tables with storage cabinets and drawers disposed beneath the table tops are well known in the art as illustrated, for example, in U.S Pat. No. 3,273,517. Such cabinetry is, however, an integral part of each table and ordinarily cannot be modified to suit the particular needs or desires of different customers. A need exists, therefore, for a drafting table having a frame which serves as a skeleton to which different combinations of file units, drawer units, shelf units, and the like, may be secured to meet the specific preferences and requirements of users.

Despite its skeleton frame construction, such a frame should provide the advantages of counterbalancing and self-leveling found in premium quality drafting tables. While counterbalancing and/or self-leveling mechanisms are known (see, for example, U.S. Pat. Nos. 3,370,556, 3,213,809, and 2,982,050), applicants are unaware of any prior construction in which such mechanisms are completely contained within the members of a generally U-shaped frame so as to leave ample room within the opening defined by the frame members for supporting an arrangement of selected modular storage units. Other patents of general interest are U.S. Pat. Nos. 2,560,928, 3,381,634, 3,364,881, and 3,283,731.

In brief summary, this invention is concerned with an open-frame two-post drafting table having a base, the base including a horizontal base beam and a pair of upstanding telescoping columns at opposite ends of that beam. Each column includes generally tubular upper and lower column sections, the lower sections being secured to the base beam and the upper sections being slidably extendable and retractable relative to the lower sections. Means are provided within the base beam and the telescoping columns for counterbalancing the upper sections and the table top carried thereby and for synchronizing the movement of the upper telescoping sections to insure self-leveling of the table top regardless of its position of vertical adjustment. The counterbalancing and synchronizing means includes a cable which, in the embodiment disclosed, extends in an endless loop through the base beam and into each of the columns. Friction-reducing guide means in the form of pulleys are disposed within each of the columns, and within the base at its opposite ends, for supporting and guiding movement of the loop of cable. The loop has a pair of vertically-extending stretches disposed within each of the columns, the stretches being movable in opposite vertical directions as the endless loop of cable travels one way or the other. The upper sections of the respective columns are secured to those stretches of cable which travel in the same vertical direction within the columns, and spring means disposed within the hollow base urges the loop of cable in one direction to counterbalance the weight of the upper column sections and the top supported thereby. Adjustment of the counterbalancing force may be achieved simply by altering the points at which the upper sections of the columns are secured to the control cable. Since the entire counterbalancing and self-leveling mechanisms are housed within the hollow frame members, and since such members are relatively narrow, leaving a large space between the upstanding columns, various modular units or arrangements of such units may be supported within the space to meet the needs and preferences of users. Furthermore, such arrangements may be modified from time to time as needs change without in any way affecting the counterbalancing and self-leveling mechanism housed within the frame.

Further advantages and objects of the invention will become apparent from the specification and drawings.

DRAWINGS

FIG. 1 is a perspective view of a two-post drafting table embodying the invention, the table being illustrated without any modular storage units supported by the frame.

FIG. 2 is a rear perspective view of the same table illustrating how modular drawer and file units (in phantom) might be supported by the frame.

FIG. 3 is an enlarged fragmentary perspective view of the base frame illustrated in FIG. 1, the table top being omitted and certain parts of the base being illustrated in phantom for clarity of illustration.

FIG. 4 is an exploded fragmentary perspective view illustrating details of the column and base beam construction.

FIG. 5 is an end elevational view of the base assembly.

FIG. 6 is an enlarged detailed view of a modified stalk construction which facilitates tension adjustment of the cable.

DETAILED DESCRIPTION

Referring to the drawings, FIG. 1 illustrates a drafting table 10 having a table top 11 and a supporting base 12. The base includes an elongated horizontal beam or frame member 13, stabilizing end members 14, and upstanding support columns 15. It will be observed that beam 13 and columns 15 combine to define a portion of the base that is U-shaped in configuration, providing a large rectangular opening or space 16 above the beam and between the columns which is capable of accommodating various modular storage units. Thus, as illustrated in phantom in FIG. 2, a file drawer unit 17 may be mounted upon beam 13 against one of the columns 15 and a reference drawer unit 18 may be secured between the columns 15 above module 17. If desired, one or both of the modules 17 and 18 may be omitted, or a second file drawer module 17 may be mounted beneath the reference module 18 in the remaining space illustrated in FIG. 2. The arrangement depicted in FIG. 2 is given only for purposes of illustration; it is to be understood that different modules of different size, and different arrangements of modules, may be secured within the rectangular space 16 to meet the individual needs and preferences of different users.

The board or top 11 is mounted in a conventional manner so that it may be tilted and locked in any selected angle of adjustment. The locking mechanism may include a bar 19 which not only contributes to the locking function but may incorporate a torsion bar mechanism as set forth in U.S. Pat. No. 3,273,517. Any suitable pivot adjustment and counterbalancing mechanism may of course be used.

FIG. 3 illustrates the base assembly in greater detail. Horizontal beam 13 is hollow and of rectangular cross section, and upstanding columns 15 are each composed of telescoping upper and lower sections 15*a* and 15*b*. The column sections are tubular and rectangular in horizontal section. In the embodiment shown, the larger lower sections 15*b* are welded or otherwise secured to the base beam 13 adjacent opposite ends thereof and the smaller upper sections 15*a* are vertically slidable between raised and lowered positions for selective adjustment of the elevation of the table top 11 carried by those upper sections (FIGS. 1 and 2) although, if desired, the arrangement might be reversed so that the slidable upper sections 15*a* are the larger sections and telescopingly receive the smaller lower sections 15*b*.

Construction details of the column sections are illustrated in FIGS. 4 and 5. Upper section 15*a* may be fabricated from sheet metal panels 21 and 22, panel 21 being formed to define side wall 21*a*, front wall 21*b*, and rear wall 21*c*. Panel 22 is formed to define side wall 22*a* and top wall 22*b*. The panels may be welded or otherwise securely fastened together to provide each of the upper column sections 15*a* shown in assembled form in FIGS. 3 and 5.

Each lower column section 15*b* may be similarly formed of panels 23 and 24 secured together to form the box-like open-ended tubular section. Specifically, panel 24 may be formed to define side wall 24*a*, front wall 24*b*, and rear wall 24*c*. The side panel 23 which defines the remaining side wall is illustrated in fragmentary form in FIG. 3 but is omitted from FIGS. 4 and 5 so that the interior of the lower column section 15*b* will be visible.

Within each lower column section is a channel-shaped standard or stalk 25 which is supported at its lower end by end plate 31 (tongue 26 of the stalk is also received in slot 27 of the beam as shown in FIG. 4) and is provided at its upper end with anti-friction means in the form of pulley 28. The pulley is carried by a shaft which extends through vertically-elongated slot 29 adjacent the upper end of the stalk, a nut 30 being secured to the end of the shaft to hold the pulley in a selected position of adjustment along the length of slot 29. Such an arrangement permits repositioning of the pulley for the purpose of adjusting tension of the cable as will be described more fully hereinafter.

Beam 13 is closed at its opposite ends by end plates 31, one of such plates being illustrated in detail in FIG. 4. Each such plate is provided with a pair of inwardly projecting ears 32 which are apertured to support a shaft 33, the shaft in turn carrying a pair of independently rotatable pulleys 34 (FIGS. 3 and 5). A cable 35 extends in a continuous loop through the interior of beam 13 and upwardly into the hollow columns 15. As shown in FIG. 3, the cable 35 extends about upper pulleys 28 and lower sets of pulleys 34, the cable being maintained in taut condition by proper adjustment of one (or both) upper pulleys 28. In each column there are therefore two stretches of cable 35*a* and 35*b*, one stretch 35*a* being disposed closer to front wall 24*b* and the other stretch being disposed closer to rear wall 24*c*. Counterbalancing means for counterbalancing the table top is also disposed within the hollow base. In the construction illustrated, the counterbalancing means takes the form of a tension spring 36 disposed within beam 13, the spring having one end secured to the base and the opposite end hooked to a small loop or eyelet 37 of the cable disposed within the beam. The spring exerts a pulling force which, referring to FIG. 3, urges the stretch of cable 35*a* in the right column in an upward direction. The spring also urges the stretch of cable 35*b* in the left column in an upward direction. Clamping means in the form of brackets 38 and 39 tightly secure the upwardly-urged stretches of cable to the lower ends of column sections 15*a*. As indicated in FIG. 4, each bracket or clamping plate 38–39 is held in place by screws 40. The counterbalancing force exerted by the spring 36 may be easily adjusted by simply altering the points where brackets 38–39 clamp the continuous timing cable 35. Ideally, such adjustment is made until the upward force exerted by the spring upon the upper column sections counterbalances the weight of those sections, the drafting board or top 11 carried thereby, and any drafting machine or other apparatus that may be secured to the top. For the purpose of making such adjustment, the side walls 23 of the lower telescoping sections 15*b* should be removable, thereby permitting access to the screws 40 for the respective brackets or plates 38–39. Once a selected elevation has been attained, the telescoping sections are locked in their positions of adjustment by any suitable locking means. In the illustration given, a pair of knob-equipped set screws 41 extend through threaded opeings 41*a* in the front walls 24*b* of the lower column sections and are engageable with the front walls 21*b* of the upper sections to hold the upper sections in their adjusted positions. It is to be understood, however, that other locking means may be provided; for example, the base may be equipped with a suitable releasable clamp for holding the cable 35 immovable with respect to beam 13.

Throughout the specification, the cable 35 has been described as extending in a continuous loop through the hollow base. While the loop as shown is indeed continuous, it will be observed from FIG. 3 that the cable is actually of finite length with its ends joined by clamp 42 to form that loop. Also, while clamps 38 and 39 secure uninterrupted stretches of that loop to telescoping upper sections 15*a*, it is believed apparent that similar results might be achieved in a more complex and perhaps less effective (less adjustable) manner by severing the cable adjacent clamps 38 and 39 and then resecuring the cable ends to the upper telescoping sections by any suitable attachment means.

FIG. 6 depicts a modification of the cable tension adjusting means. Stalk 25' is identical to the stalk already described except that it is equipped at its upper end with a cap 50 having a threaded opening therein. A screw 51 is threadedly received in that opening, the screw extending through an aperture in the horizontal arm 52*a* of angle member 52. The vertical arm 52*b* of the angle member is apertured near its lower end to support the shaft 53 of pulley 28'. When vertical adjustment of the pulley is desired, the head 51*a* of the screw 51 is rotated to urge lock nut 54 either upwardly or downwardly, the lock nut supporting angle member 52. It is believed apparent that nut 30' at the end of pulley shaft 53 must be loosened sufficiently to permit such adjustment, after which it may be retightened to assist in maintaining the pulley in its selected position.

Although connecting beam 13 has been disclosed as joining the lower ends of columns 15*b*, it is to be understood that beam 13 might be relocated upwardly and might even bridge the upper ends of the lower telescoping column sections 15, in which case the modular units 17–18 would be disposed in the space 16 below rather than above that beam. In other respects such a modification would be similar structurally and functionally to the one already described and shown, although it is believed apparent that if the hollow beam 13 bridged the upper ends of lower telescoping sections 15*b*, then the stalks 25 would extend downwardly instead of upwardly within those column sections.

While in the foregoing embodiments of the invention have been disclosed in considerable detail for purposes of illustration, it will be understood by those skilled in the art that many of these details may be varied without departing from the spirit and scope of the invention.

We claim:

1. A table including a base having a hollow horizontal beam and a pair of hollow upstanding columns at opposite ends of said beam, each column comprising upper and lower column sections, said lower sections being secured to said beam adjacent their lower ends, a table top carried by said upper sections, said upper sections being vertically slidable between raised and lowered positions for selected adjustment of the elevation of said top, and means for synchronizing the movement of said upper sections and for counterbalancing said upper sections and said top carried thereby, said means including a cable extending in an endless loop through said beam and upwardly into each of said columns, guide means disposed within each of said columns and within said beam for supporting and guiding movement of said loop of cable, said loop having a pair of vertically-extending stretches disposed within each of said columns and movable in opposite vertical directions as said loop of cable is moved, spring means in said base connected to said cable and base for urging said loop of cable in one direction, securing means in each of said upper column sections for securing said sections to those stretches of cable in said columns urged upwardly by said spring, whereby, said cable synchronizes movement of said upper sections to maintain said top in level condition while said spring means acting through said cable counterbalances the weight of said upper sections and top, said guide means comprising pulleys mounted in said beam and said column, and stalks extending upwardly within said lower column sections and into said upper column sections, said pulley mounted within said columns being rotatably supported by said stalks at the upper ends thereof, at least one of said pulleys within said columns being carried by a horizontal shaft extending through a vertically-elongated slot in said stalk, said shaft being movable along said slot to vary the tension of said cable, and means for holding said shaft in a selected position of adjustment along the length of said slot, said last-mentioned means comprising an angle member disposed adjacent the upper end of said stalk, said angle member including a vertical arm having an opening through which said shaft extends and also having a horizontal arm with an opening therein, and an adjustment screw extending through the opening of said upper arm and threadedly received by said stalk, said screw being provided with means engagable with said angle member for shifting said member when said screw is rotated.

2. The table of claim 1 in which said pulleys at the upper ends of said stalks are mounted for rotation about horizontal axes parallel with said beam.

3. A table including a U-shaped base having a hollow horizontal beam adapted to extend along a floor surface and a pair of hollow upstanding columns at opposite ends of said beam, each column comprising upper and lower column sections, said lower section being secured to said beam adjacent their lower ends, a table top carried by said upper sections and spaced above said beam to define a space between said beam and table top and between said upstanding columns for receiving a modular storage unit, said upper sections being vertically slidable between raised and lowered positions for selected adjustment of the elevation of said top, and means for synchronizing the movement of said upper sections and for counterbalancing said upper sections and said top carried thereby, said means including a cable extending in an endless loop through said beam and upwardly into each of said columns, guide means disposed within each of said columns and within said beam for supporting and guiding movement of said loop of cable, said loop having a pair of vertically-extending stretches disposed within each of said columns and movable in opposite vertical directions as said loop of cable is moved, spring means in said base connected to said cable and base for urging said loop of cable in one direction, and securing means in each of said upper column sections for securing said sections to those stretches of cable in said columns urged upwardly by said spring, whereby, said cable synchronizes movement of said upper sections to maintain said top in level condition while said spring means acting through said cable counterbalances the weight of said upper sections and top, said means for synchronizing and counterbalancing said upper sections being completely contained and concealed within the hollow columns and beam of said base.

* * * * *